United States Patent [19]

Covington, Jr.

[11] 4,035,746

[45] July 12, 1977

[54] CONCENTRIC BROADBAND POWER COMBINER OR DIVIDER

[75] Inventor: Martin Bryan Covington, Jr., Baltimore County, Md.

[73] Assignee: The Bendix Corporation, Southfield, Mich.

[21] Appl. No.: 720,877

[22] Filed: Sept. 7, 1976

[51] Int. Cl.[2] ..... H01P 5/12

[52] U.S. Cl. ..... 333/6; 333/9

[58] Field of Search ..... 333/1, 6, 9, 96, 97 R

[56] References Cited

U.S. PATENT DOCUMENTS

| | | | |
|---|---|---|---|
| 2,630,487 | 3/1953 | Gurewitsch | 333/97 R |
| 3,091,743 | 5/1963 | Wilkinson | 333/9 |

FOREIGN PATENT DOCUMENTS

| | | | |
|---|---|---|---|
| 185,977 | 9/1966 | U.S.S.R. | 333/9 |

*Primary Examiner*—Paul L. Gensler

*Attorney, Agent, or Firm*—W. G. Christoforo; Bruce L. Lamb

[57] ABSTRACT

A broadband concentric power combiner or divider for use with microwave frequency signals is in the form of a multi-section folded transmission line. The folded transmission line is comprised of a plurality of concentric cylinders wherein the outer conductor of one section comprises the inner conductor of an adjacent section, the various cylinders being the various conductors.

6 Claims, 4 Drawing Figures

CONCENTRIC BROADBAND POWER COMBINER OR DIVIDER

BACKGROUND OF THE INVENTION

This invention relates to a microwave frequency device which can be used as either a broadband high power divider or combiner of reasonable size.

Known broadband microwave combiners have normally been of the three db hybrid combiner type or have alternately comprised long multi-section linear transmission line devices. The three db hybrid type are characterized by their complexity and the high RF losses associated therewith. The multi-section transmission line devices overcome the above-mentioned deficiencies of the three db hybrid type but at the expense of the extremely long and bulky physical form of the linear multi-section network.

SUMMARY OF THE INVENTION

The present invention employs the principles of the above-mentioned linear multi-section network combiner but improves the basic design thereof by folding various sections of the transmission line comprising the combiner to thereby reduce the length thereof to about the length of a single quarter wavelength section of transmission line. This is accomplished by providing two sets of concentric cylinders which nest within one another so that the cylinders of one set are interleaved with the cylinders of the other set. The cylinders increase in size from a small cylinder whose longitudinal axis coincides with the longitudinal axis of the device and which comprises an extension of the center conductor of a first connector to an outside cylinder which forms not only the outside conductor of the largest diameter transmission line but also, in the embodiment to be described, comprises an outside wall of the device. A plurality of the spaced annularly arranged second connectors are provided at an end of the device opposite the first connector and have their center conductors electrically connected to the inner conductor of the largest transmission line section and their outer conductors connected to the outer conductor of the same transmission line section.

When the device is used as a power divider input power is provided at the first connector and taken off at the various second connectors. When used as a power combiner input power is provided at the various second connectors and output power taken off at the first connector.

One object of this invention is to provide a concentric broadband power combiner of convenient size and reasonable length.

Another object of this invention is to provide a concentric broadband power divider of convenient size and reasonable length.

DESCRIPTION OF THE PREFERRED EMBODIMENT

Figure 4:
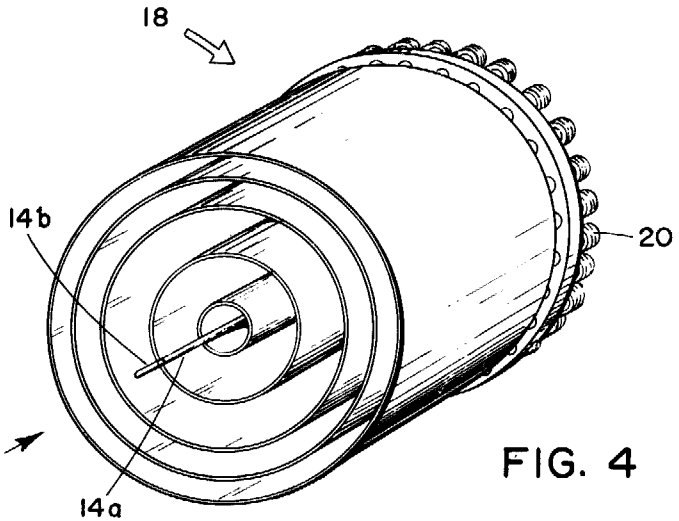
FIG. 4 shows the other set of concentric cylinders.
Figure 1:
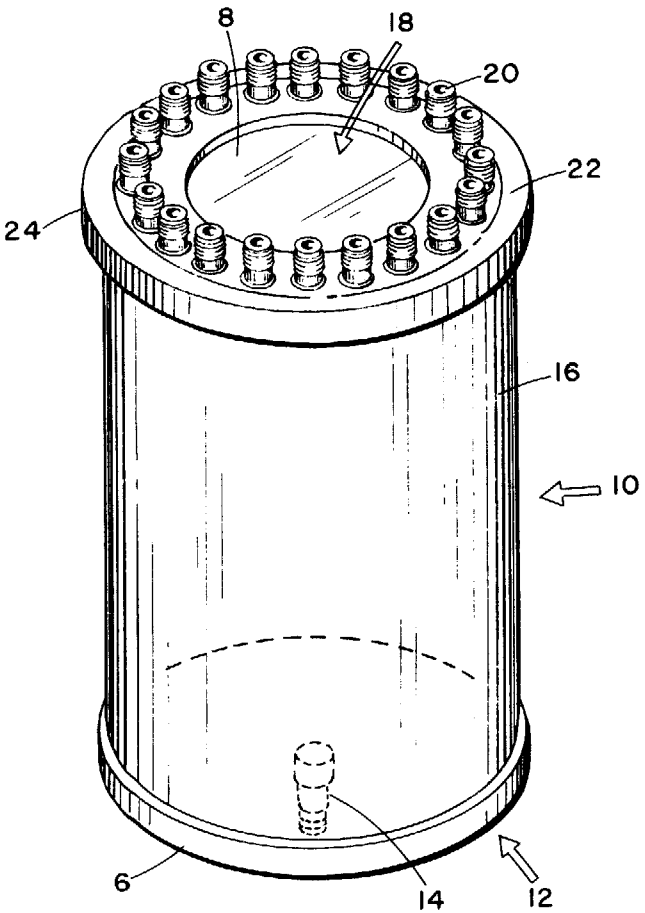
FIG. 1 shows an embodiment of the invention in oblique view.
Figure 2:
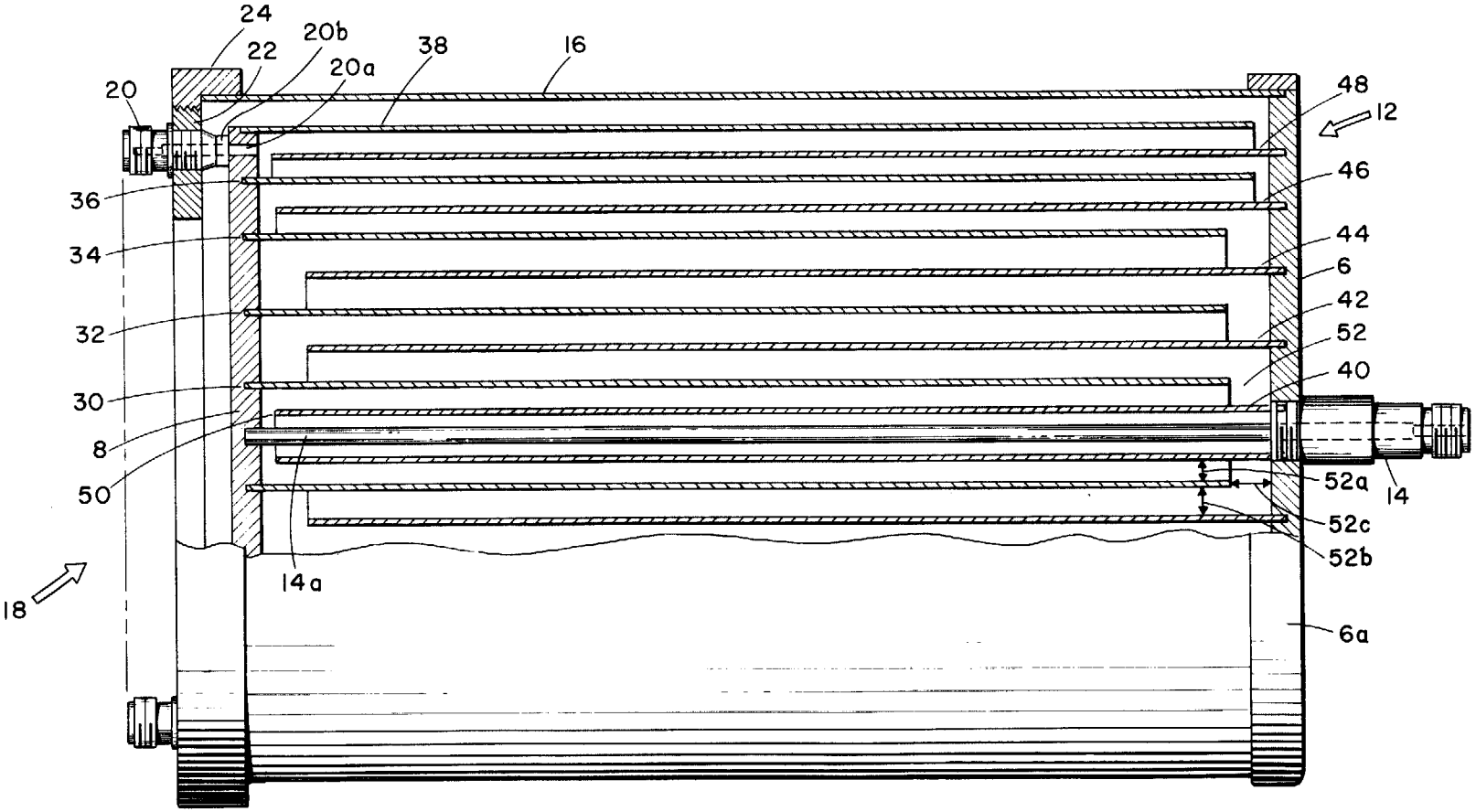
FIG. 2 shows the embodiment of FIG. 1 in section through the longitudinal axis thereof.

Referring first to FIGS. 1 and 2, this embodiment of the invention is seen to be in a cylindrical shape which includes external cylinder 16, an end plate 6 having mounted therein a coaxial connector 14, and an opposite end plate 8 having mounted thereon an annular ring 22 through a plurality of evenly spaced second connectors 20, as will be explained in greater detail below. Device 10 is comprised of two sets of nested cylinders, sets 12 and 18, which are seen in greater detail at FIGS. 3 and 4, respectively. FIG. 4 also shows conductor 14*b* which is an extension of center conductor 14*a* of connector 14. Conductor 14*b* is adapted to slip into connector 14 when sets 12 and 18 are nested together. The end of conductor 14*a*, not shown in FIG. 4, is electrically connected, suitably by soldering, to end plate 8, as will be shown below with respect to FIG. 2.

Figure 3:
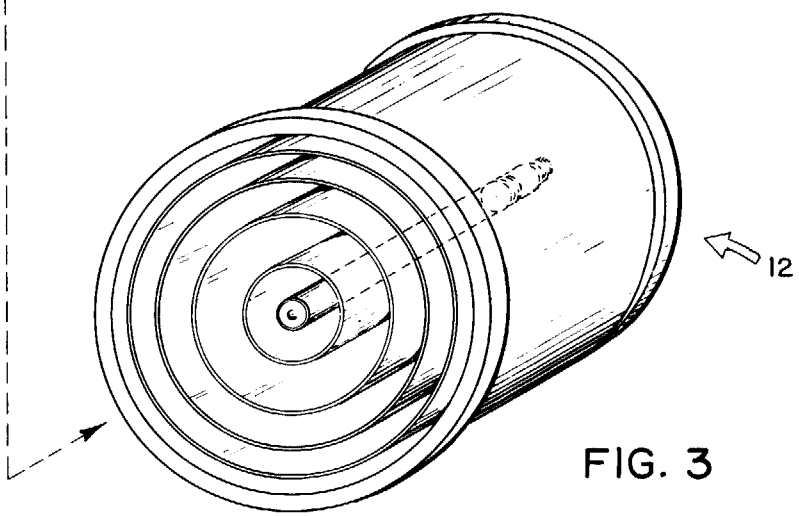
FIG. 3 shows one set of concentric cylinders comprising the conductors of various of the transmission lines making up this embodiment of the invention.

Refer now particularly to FIG. 2 which shows the internal construction of device 10, the figure being a section through the longitudinal axis of the device. Connector 14 is seen concentrically connected to end plate 6 with center conductor 14*a* attached therein at one end (end 14*b* of FIG. 4) and soldered or otherwise electrically connected to end plate 8 at its opposite end. The set of cylinders 12 previously seen at FIG. 3 is seen to be comprised of concentric cylinders 40, 42, 44, 46, 48 and 16, the last of which comprises the exterior cylindrical wall of the device, and end plate 6 to which one end of the above-mentioned cylinders are electrically attached, suitably through soldering. An annular ring 6*a* is soldered at the junction of cylinder 16 and plate 6 to provide support. A second annular ring 24 is soldered at the opposite end of cylinder 16 and is provided with threads as shown to connect set 12 with set 18 through ring 22.

The other set of cylinders 18, previously seen in FIG. 4, is seen to be comprised of rod conductor 14*a*, and cylinders 30, 32, 34, 36 and 38, together with end plate 8. In addition, this set of cylinders has mounted thereon through connectors 20 the annular ring 22 which supports connectors 20 whose center conductors 20*a* are electrically connected to end plate 8. Ring 22 is seen to be electrically connected to cylinder 16 and physically mounted thereto through the mating threads of ring 22 and support collar 24, which comprises a portion of cylinder 16 and which is also seen in FIG. 1. It should be understood that collar 24 provides physical support for the device and wall thickness for the threads mating ring 22 therewith. It should be obvious that set 12 is assembled to set 18 by rotating one set with respect to the other, whereby the threads on rings 22 and 24 engagingly mate with conductor 14*b* (FIG. 4) entering into and becoming the center conductor of connector 14.

The outer conductors of connectors 20 and hence ring 22 and the set of cylinders 12 are electrically insulated, at least with respect to DC currents, by a plurality of dielectric collars 20*b*, one of which is provided as shown for each connector 20.

When the device is used as a power divider input power is provided at connector 14. The power flows into the transmission line comprised of inner conductor 14*a* and an outer conductor comprised of cylinder 40. At the end of that transmission line, in the vicinity indicated by the numeral 50, an impedance transformation occurs and power therefor flows to the right, with respect to FIG. 2, in the transmission line which has cylinder 40 as an inner conductor and cylinder 30 as an outer conductor. At the end of that transmission line, in the space designated by numeral 52, another impedance transformation occurs and power flows to the left in a transmission line having the inner conductor comprised of cylinder 30 and an outer conductor comprised of cylinder 42. Power continues to flow in this manner through the device, the final transmission line comprising cylinder 16 which is the outer conductor thereof and cylinder 38 which is the inner conductor. Power is thereby equally distributed to connectors 20. In this particular embodiment there are 20 second connectors so that approximately 1/20 of the input power appears at each output connector.

When the device is operated as a power combiner the various input powers are applied at the various connectors 20 and the total input power combined onto the single connector 14 in a manner which now should be obvious, the power flowing through the various transmission lines in a direction opposite from that described with respect to the operation of the device as a power divider.

The distance between end plates 6 and 8 is preferably about a quarter-wavelength of the center frequency of the frequency band of signals with which the device is intended to be used.

As previously mentioned, there is an impedance transformation at the junctions of the various transmission lines. This impedance transformation occurs in the spaces, for example space 52, between transmission lines. It should be obvious that these spaces permit power to flow continuously from one transmission line to the other. As will be shown below, the proper impedance of each transmission line can be calculated, thus setting the diameters of the cylinders comprising the various transmission lines. Thus, the impedance $Z_{11}$ of the transmission line comprised of rod 14*a* and cylinder 40 can be calculated together with the impedances of the other transmission lines, for example, impedances $Z_{10}$ and $Z_9$, the impedances respectively of the transmission lines comprised of cylinders 40 and 30 and cylinders 30 and 42. Accordingly, given the diameter of rod 14*a* the diameters of the cylinders, for example, cylinders 40, 30 and 42 become determined. In other words, the dimensions denoted by double headed arrows 52*a* and 52*b* become determined. The distance between the end of a cylinder and its facing end plate, for example, the distance denoted by double headed arrow 52*c*, is chosen as the mean of distances between the cylinders comprising the bounds of the impedance transformer, for example, dimensions 52*a* and 52*b*. This method of determining the distance between the cylinder ends and the facing end plate is a nice compromise since too long a distance will cause an undesirable inductive discontinuity and too short a distance will cause an undesirable capacitive discontinuity as should be known to one skilled in the art.

As mentioned above, the relative sizes of the various cylinders which comprise the conductors of this embodiment can be determined by considering the relation of the various transmission line impedances. In addition, the number of required impedance steps and the impedance values can be determined from the required bandwidth impedance match in accordance with the Tchebvscheff theory of band-pass devices as follows:

If the maximum acceptable excess loss in the pass band is defined as E*r*, then:

$$Er = (Vr - 1)^2/4\ Vr,$$

where V*r* is the maximum VSWR in the pass band.

Likewise, if E*a* is defined as the maximum possible excess loss as a function of the transformation ratio, then:

$$Ea = (R - 1)^2/4R,$$

where R is the resistive impedance transformation ratio.

The ratio of E*a* to E*r* must not exceed the expression:

$$Tn^2\left[\frac{1}{\sin(\pi Wg/4)}\right],$$

where T*n* is the Tchebyscheff polynomial of the first kind and of order *n* and W*q* is the desired fractional bandwith. Tables of the above expression are readily available and can be found, for example, in the article "Stepped Impedance Transformers and Filter Prototypes" by Leo Young and which was published at pages 339–359 of the September 1962 issue of the IRE Transaction PGMTT-10.

A device actually built had a desired VSWR of 1.1 within the pass band, an impedance ratio of 20-to-1 and a desired pass band of 100 MHz to 500 MHz. The fraction bandwith was thus, $$Wq = \frac{500 - 100}{(500 + 100)/2} = 4/3.$$

Also:

$$Er = 0.0023$$

and $$Ea = 4.512$$

thus $$M = Ea/Er = 1961$$

The tables indicate a required *n* of at least 10. Since the device described herein requires an odd number of steps it is necessary to use the next highest odd integer, or $n = 11$.

A value of 11 for *n* and 1.3 3 for W*q* fixes the value for M as approximately 10,000. This determines the transformation impedance steps. A satisfactory method for determining the impedance values is available if R is not too large, as in the present situation. The method uses the Tchebyscheff theory of band-pass devices and particularly Tchebyscheff antenna distribution tables are used to obtain the logarithms of consecutive impedance steps. A value of M of 10,000 requires the use of the table for 40 db antenna sidelobes. The above mentioned Tchebyscheff antenna distribution table is found in "Tchebyscheff Antenna Distribution, Beamwidth and Gain Tables" by L. B. Brown and G. A. Sharpe, NAVORD Report 4629 (NOLC Report 383), Naval Ordnance Laboratory, Corona, Cal. (February 28, 1958). The element currents for a 12 element array are read from the table. A 12 element pattern is used because an 11 section transformer as described in the embodiment of this invention has 12 impedance changes. 12 element currents are weighted in a manner to produce cumulative steps equal to R when the weighted steps are used as logarithms of the impedance steps. This technique produces the following impedance values where $Z_1$ is the impedance of the largest diameter transmission line comprised of cylinders 16 and 38, $Z_{11}$ is the impedance of the innermost transmission line comprised of conductors 14a and 40, Zout is the impedance of the plurality of connectors 20 and $Z_{in}$ is the impedance of connector 14.

| | | |
|---|---|---|
| Zout | = | 2.500 ohms |
| $Z_1$ | = | 2.631 ohms |
| $Z_2$ | = | 2.945 ohms |
| $Z_3$ | = | 3.609 ohms |
| $Z_4$ | = | 4.886 ohms |
| $Z_5$ | = | 7.208 ohms |
| $Z_6$ | = | 11.8 ohms |
| $Z_7$ | = | 17.34 ohms |
| $Z_8$ | = | 24.58 ohms |
| $Z_9$ | = | 34.63 ohms |
| $Z_{10}$ | = | 42.44 ohms |
| $Z_{11}$ | = | 47.51 ohms |
| $Z_{in}$ | = | 50.00 ohms |

Although only one embodiment of this invention has been shown and described it should now be obvious to one skilled in the art that various alterations and modifications of the invention are possible. Accordingly, the invention is to be limited only by the true spirit and scope of the appended claims.

The invention claimed is:

1. A transmission line structure comprised of a first set of concentric cylinders and a second set of concentric cylinders arranged to be relatively colinear with one another so as to form a cylindrical structure having first and second opposed end plates, said first set of concentric cylinders being electrically attached at first ends thereof to said first plate and said second set of concentric cylinders being electrically attached at first ends thereof to said second plate, the cylinders of said first set being interleaved with the cylinders of said second set, the inner and outer of said cylinders being of such size to extend the entire longitudinal length of said structure and the other cylinders being of shorter longitudinal length, a first coaxial electrical connector having a center conductor connected to said inner cylinder and an outer conductor connected to said first plate and a plurality of second coaxial electrical connectors having inner conductors connected to said second plate and outer conductors connected to said outer cylinder.

2. The transmission line structure of claim 1 wherein the transmission line comprised of the inner cylinder and the next adjacent cylinder extends through said first connector.

3. The transmission line structure of claim 1 wherein said cylinders form a folded coaxial transmission line means having conductors of increasing diameter in steps from the longitudinal axis of said structure outward.

4. The transmission line structure of claim 1 intended to be used for signals within a frequency band, the length of said structure between said end plates being about a quarter-wave of the center frequency of said frequency band.

5. The transmission line structure of claim 4 wherein said cylinders form a folded coaxial transmission line means having conductors of increasing diameter in steps from the longitudinal axis of said structure outward, said transmission line means being comprised of a plurality of individual transmission lines, adjacent cylinders forming the inner and outer conductors of a transmission line.

6. The transmission line structure of claim 1 wherein said cylinders form a folded coaxial transmission line means having conductors of increasing diameter in steps from the longitudinal axis of said structure outward, said transmission line means being comprised of a plurality of individual transmission lines, adjacent cylinders forming the inner and outer conductors of a transmission line.

* * * * *